US005862954A

United States Patent [19]

Ehrensperger et al.

[11] Patent Number: 5,862,954

[45] Date of Patent: Jan. 26, 1999

[54] DEVICE FOR PRODUCING SOAP LATHER AND USE THEREOF

[75] Inventors: Markus Ehrensperger, Hettlingen, Switzerland; Rupert Pachler, Meiningen, Austria

[73] Assignee: CWS International AG, Baar, Switzerland

[21] Appl. No.: 776,077

[22] PCT Filed: Jul. 17, 1995

[86] PCT No.: PCT/CH95/00165

§ 371 Date: Jan. 29, 1997

§ 102(e) Date: Jan. 29, 1997

[87] PCT Pub. No.: WO96/02178

PCT Pub. Date: Feb. 1, 1996

[30] Foreign Application Priority Data

Jul. 18, 1994 [CH] Switzerland ..... 2276/94

[51] Int. Cl.[6] ..... B67D 5/06

[52] U.S. Cl. ..... 222/190; 222/388; 239/434; 239/428.5

[58] Field of Search ..... 222/388, 145.5, 222/190, 195; 239/428.5, 418, 421, 426, 433, 434, 343

[56] References Cited

U.S. PATENT DOCUMENTS

| | | | |
|---|---|---|---|
| 3,168,217 | 2/1965 | Nilsen et al. | 222/145.5 |
| 4,174,056 | 11/1979 | Loeffler | 239/333 |
| 4,477,000 | 10/1984 | Arabian | 222/190 |
| 5,570,819 | 11/1996 | Uehira et al. | 222/190 |

FOREIGN PATENT DOCUMENTS

| | | | |
|---|---|---|---|
| 019582 | 11/1980 | European Pat. Off. | A95D 27/10 |
| 023995 | 2/1981 | European Pat. Off. | A47K 5/12 |
| 079853 | 5/1983 | European Pat. Off. | A45D 27/10 |
| 676456 | 1/1991 | Switzerland | D65D 83/76 |
| 676227 | 2/1995 | Switzerland | A47K 5/12 |

*Primary Examiner*—Steven O. Douglas

*Attorney, Agent, or Firm*—Schweitzer Cornman Gross & Bondell LLP

[57] ABSTRACT

Soap lather dispensers are known which process soap solution and air via a flexible arrangement in a foaming unit to produce lather. These devices are either costly to manufacture or produce lather of unreliable and/or poor quality. A uniform lather quality can be ensured independently of the actuation path (P) by a metering pump (1) which operates synchronously with the air pump (12) and has no dead spaces. With special blower units, in particular by the incorporation of the foaming unit (18) in an air chamber (17), the lather quality is further improved. The device is suitable in particular for frequent use in public washrooms.

11 Claims, 6 Drawing Sheets

DEVICE FOR PRODUCING SOAP LATHER AND USE THEREOF

The present invention refers to an appliance for the formation of soap foam, with a soap solution metering pump actuated by a single lever, containing a reciprocating piston in its cylindrical space, and a device for compressing and introducing air, coaxial to the metering pump and capable of reciprocating motion, and moved synchronously with the latter, and in which openings and/or ducts which are capable of being closed lead into a foaming unit where fine-bubbled foam portions are formed.

BACKGROUND OF THE INVENTION

A device corresponding to the preamble for dispensing cleaning or disinfection agents or the like is known from CH-A5-676 227. This design is based on production engineering adaptations to the designs in EP-A1-0 019 582 and EP-A1-0 079 853.

The foaming unit used here is also already known (CH-A5-676 456) and is most commonly used in the closures and dispensers fitted to bottles, usually plastic. Pressing the bottle walls causes liquid and air to be pressed into the "foamer" mounted on the bottle, where it is swirled, foamed, forced through a microfilter and dispensed directly at the nozzle as foam. In all the design forms, tolerances necessary for production engineering reasons are compensated by relative movement between the parts.

The known appliances are of relatively complicated construction (EP-A1-0 019 582 and EPA1-0 079 853) or leave something to be desired in their foam quality (CH-A5-676 227). The sizes of the individual foam portions differ with slow movements and quick movements of the lever; the valves and arrangements used tend to dribble. In addition, the air buffers in the metering pump, which are intended to ensure the ejection of the soap, have a negative effect on the constancy of the metered quantity.

BRIEF SUMMARY OF THE INVENTION

The task of the invention is therefore to create a device which does not exhibit the disadvantages of the state of the art, has high operational reliability and, even after prolonged interruptions, delivers perfect, fine-pored foam. At the same time the construction should be economically designed and in particular be suitable for mass production.

The task is solved by designing the cylindrical space as flat at its end face, arranging a ball inlet valve and spring-loaded ball outlet valve opposite each other at the end face of the cylindrical space, designing the piston head as flat at its end face, and arranging the lever so that it forces the piston to make positive contact with the end face of the cylindrical space when in its end position.

The design of the cylindrical space in accordance with the invention allows precise and synchronous metering of liquid soap and of air, so that uniform foam formation results regardless of lever travel. Furthermore, the fact that the end face of the piston makes contact with the end face of the cylindrical space gives a defined stroke and thus defined delivery quantities, without any residual volumes occurring. This solution is also favourable and inexpensive from a production engineering viewpoint; other positive contact designs of the piston and the cylindrical space are equally feasible, but less favourable for adjusting to each other.

The optimum arrangement of the valves is equally important for repeatable metering of the soap solution.

Incorporation of a chamfered piston face and cylindrical space is favourable from a production engineering viewpoint and allows the contact surface between the piston and the cylindrical space to be precisely defined without subjecting either of the two parts to wear.

The selection of the ball for the inlet valve with a lower density than that of the soap solution results in a valve ball which floats in the soap solution and is therefore always fully ready for use.

Balls made of elastomer have proved particularly successful, as this gives optimum sealing tightness with minimal spring pressure.

Inclusion of an expansion/conditioning chamber downstream of a foaming unit which in itself is already known gives improved foam quality and allows the foaming unit to be protected against drying out.

The siphon-like expansion/conditioning chamber is especially favourable; it serves on the one hand to compress and homogenise the foam, and on the other hand its vertical part can be easily cleaned.

The incorporation of a facility for coaxially blowing through the conditioning part, increases the operational readiness of the appliance, particularly after prolonged periods of non-use.

The utilisation of the compressed air produced in the air pump for blowing through, or for pressure generation, is particularly favourable.

Inserting an intermediate orifice forces the soap foam to contract, and contributes to its homogenisation after the subsequent repeated expansion. In addition, once the soap foam has been blown out, the orifice acts against the downstream expansion part as a defined boundary of minimum area and thereby reduces the ingress of air into the conditioning part and the foaming unit.

The addition of an anti-fluctuation chamber ensures an even coaxial flow towards the foaming unit, which in itself is already known.

The air buffer can be realised in a simple form by a outer ring groove in the foaming unit, and improves the flow conditions in the inlet region of the foaming unit.

Due to its very low consumption of soap solution, the appliance in accordance with the invention is ideally suited for use in public washrooms, particularly in toilets. The appliance is largely maintenance-free; the soap solution bottle can be replaced every few days or every few weeks, depending on frequency.

BRIEF DESCRIPTION OF THE SEVERAL VIEWS OF THE DRAWINGS

Practical design examples of the object of the invention are described below with the drawings. The same functional parts are designated by the same item numbers in all the drawings.

For reasons of clarity, the usual hatching has been omitted in several of the drawings; they are therefore referred to as quasi-sectional drawings.

Figure 1:
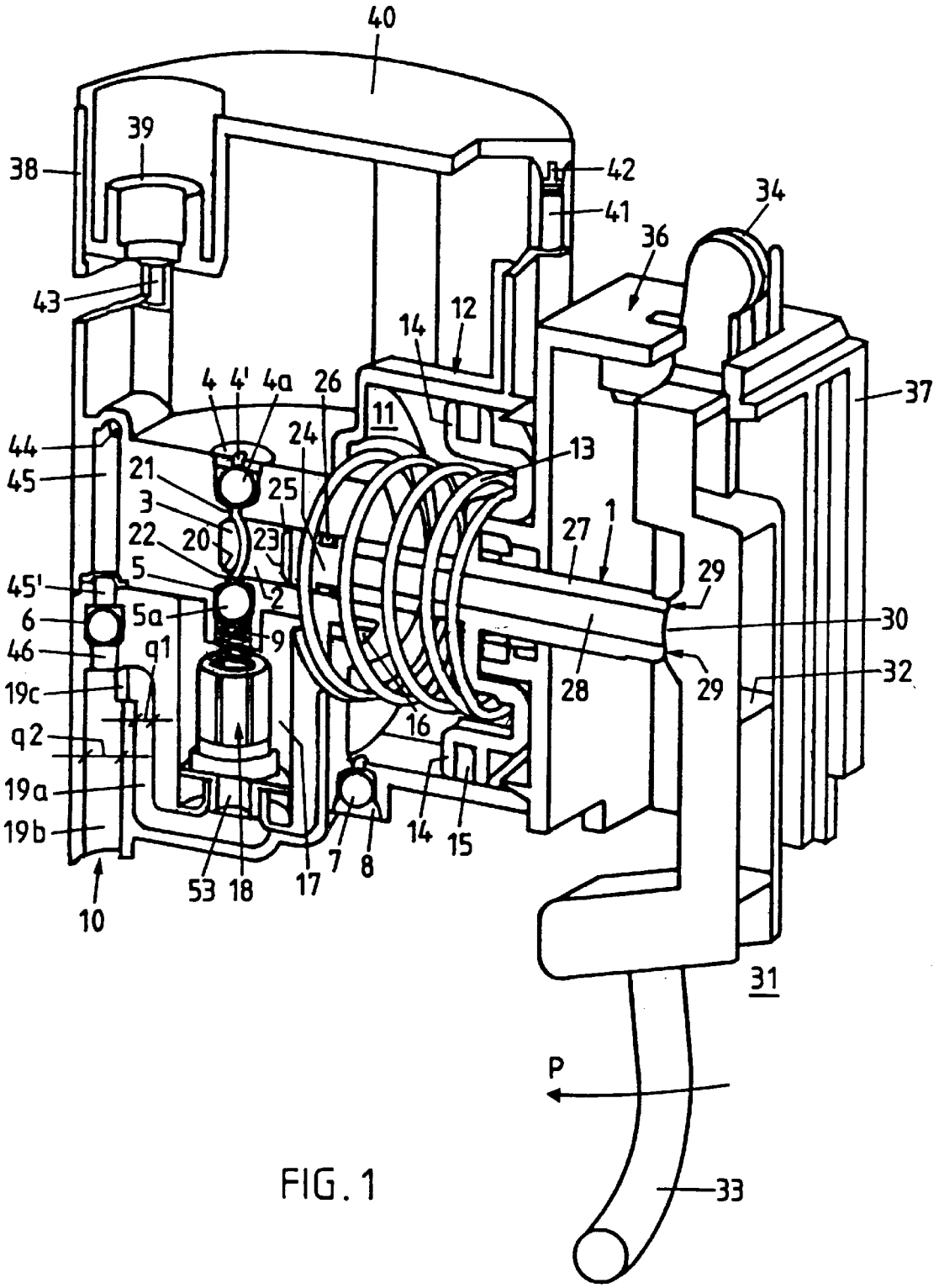
Figure 2:
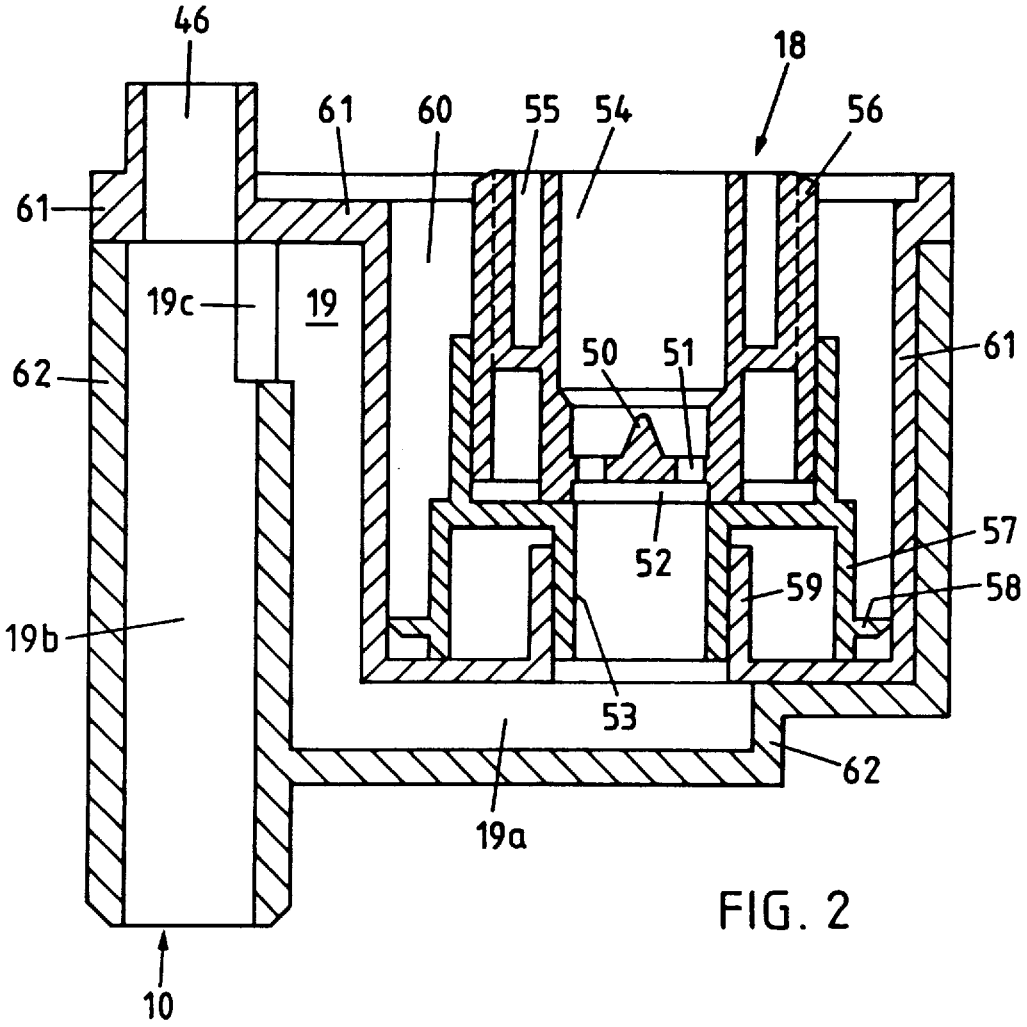
Figure 3:
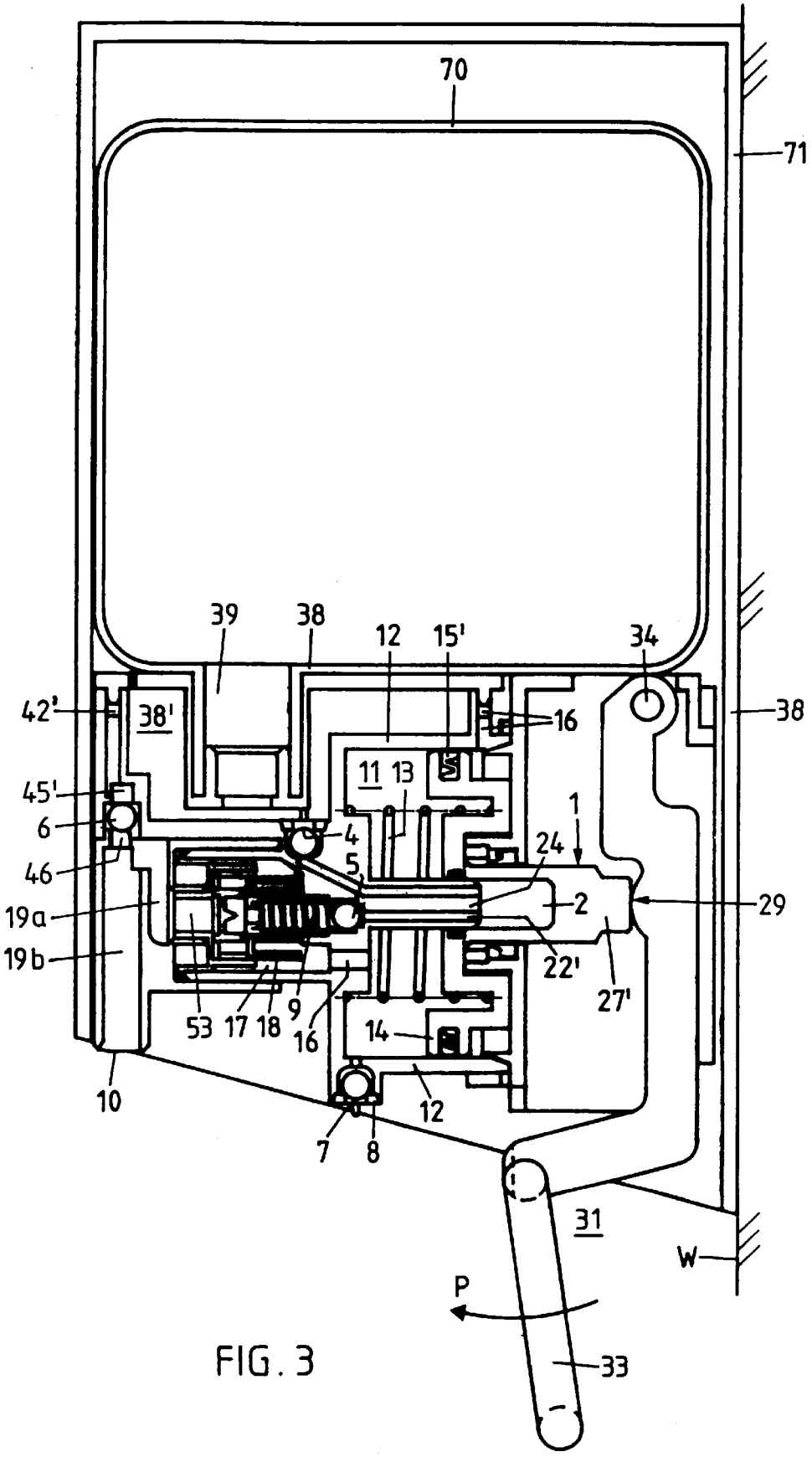
Figure 4:
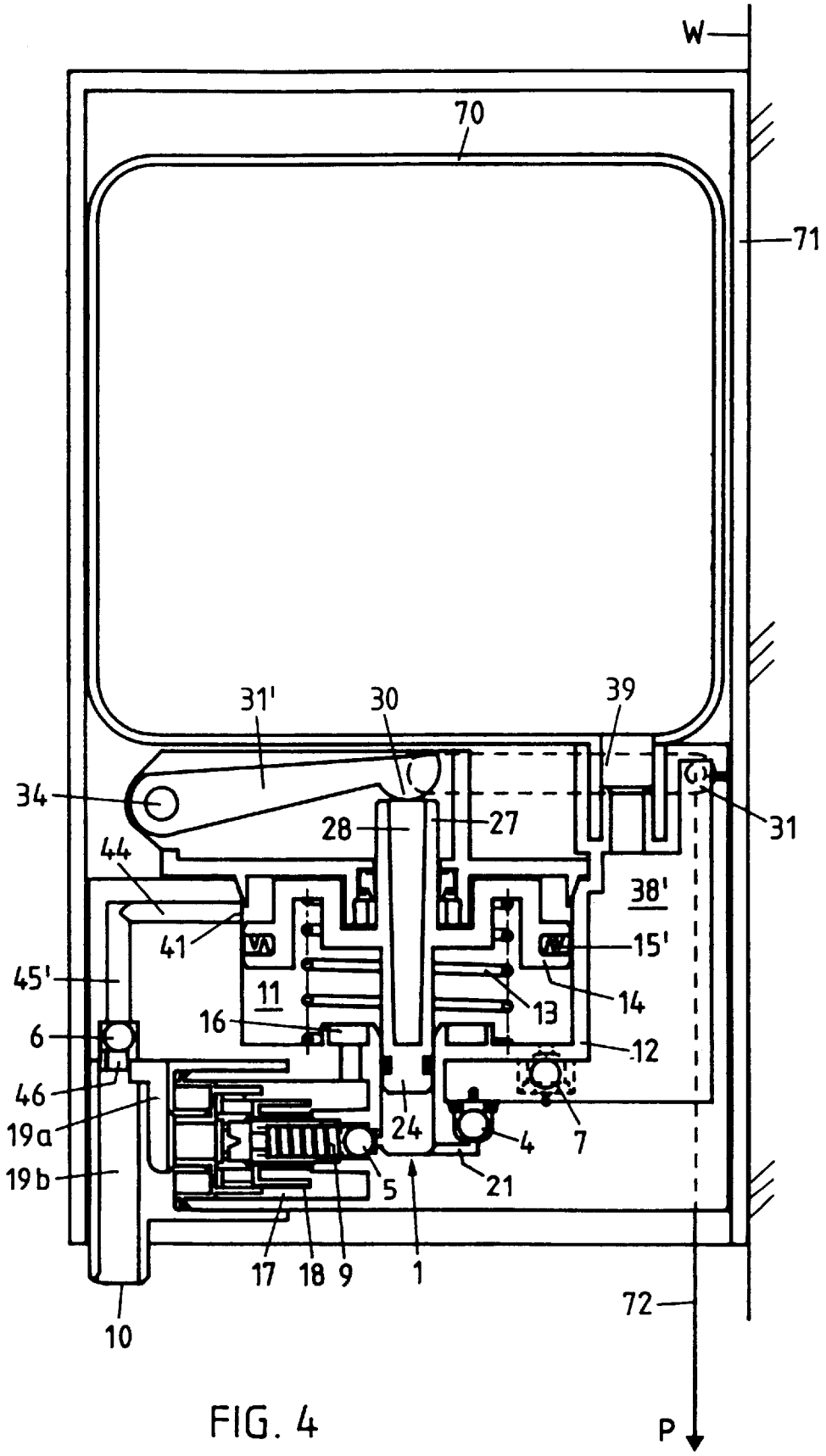
Figure 5:
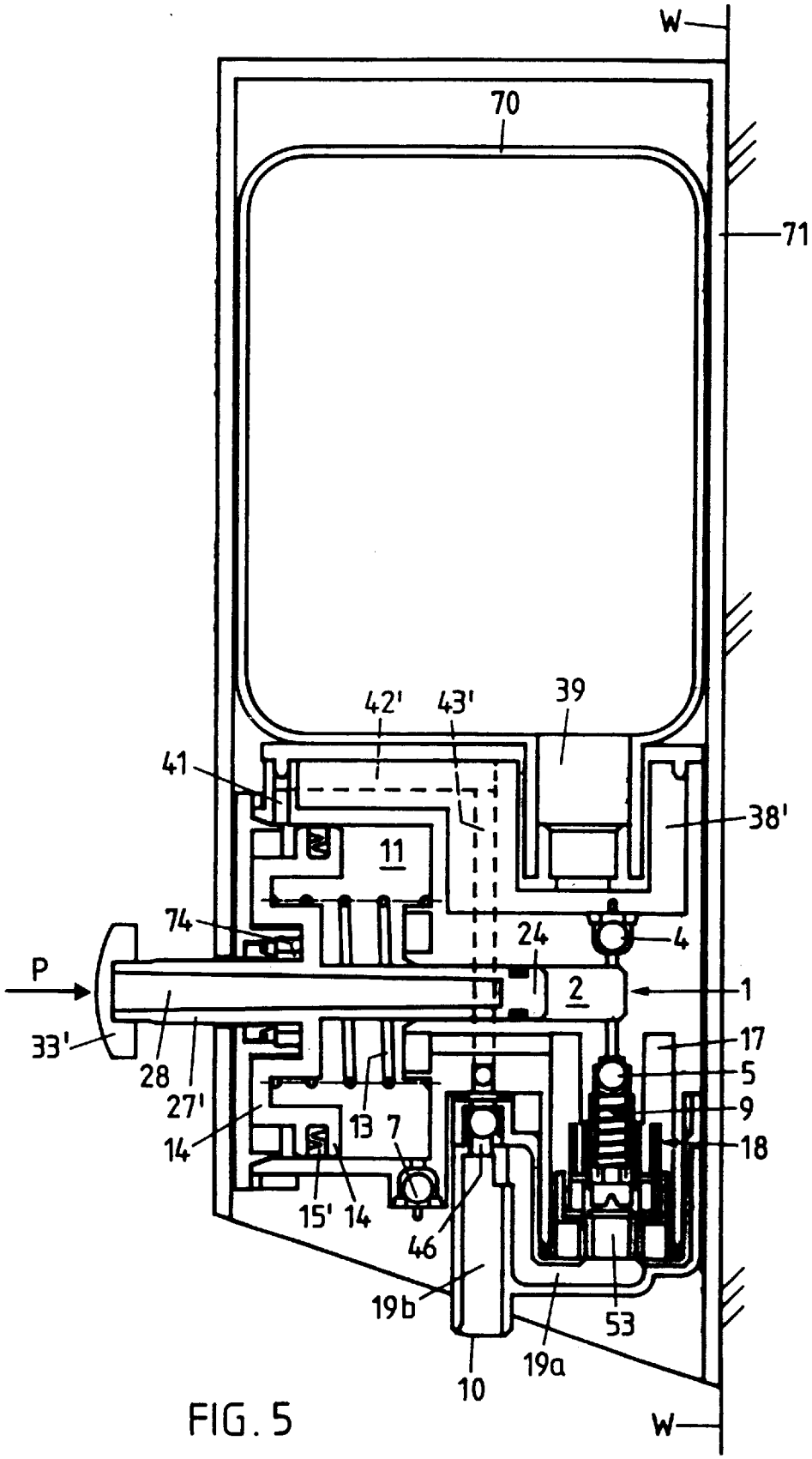
Figure 6:
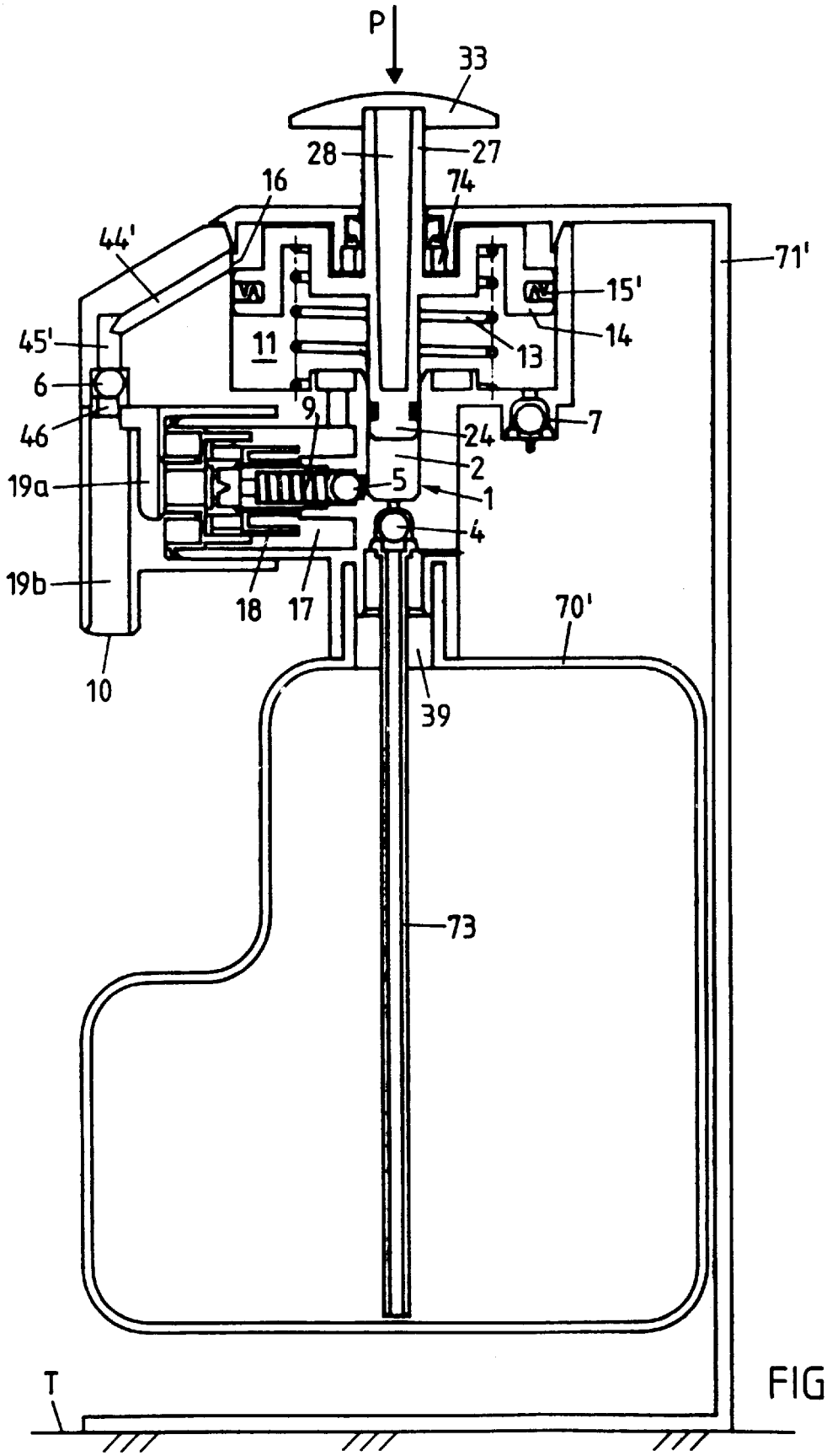

These are:

FIG. 1 a perspective view of a lever-actuated foam dispenser, as a quasi-section FIG. 2 an enlarged view of a foaming unit as in FIG. 1, with the components which enclose it immediately, shown as a normal sectional view FIG. 3 a further development of foam dispenser, utilising the entire volume of the housing, as a quasi-section, FIG. 4 a variant of a foam dispenser, intended for actuation by foot, and FIG. 5 a further variant of foam dispenser, actuated by a push button, FIG. 6 another foam dispenser, also actuated by a push button, and designed as a free-standing table-top model.

DETAILED DESCRIPTION OF THE INVENTION

FIG. 1 shows a foam dispenser, which is compatible with the previous model in accordance with EP-A1-0 019 582 and EP-A1-0 079 853 and millions of which have been manufactured. The item 1 is a metering pump with a cylindrical space 2 for soap solution. This cylindrical space 2 has a flat surface at the end. An inlet valve 4 with a floating ball 4*a* is arranged above the flat surface, and an outlet valve 5 with a ball 5*a* opposite it underneath. Corresponding inlet and outlet passages designated 21 and 22 respectively lead into a chamfer 20 in the cylindrical space 2. A piston head 24, with a chamfer 25 at the same angle and a flat end face 23, has a seal 26, in the form of a commercially-available O-ring, and is operated by a flexible piston rod 27 with a hollow space 28. At its end, the piston rod 27 has a flat sliding pressure surface 29, against which the cam 30 of a yoke 31 with a bracing strut 32 and a ring-shaped actuator lever 33, used to operate the dispenser, presses.

An air pump 12 is arranged concentric to the metering pump, which via a compression spring 13 supported in its housing presses a flexible piston 14 with double lips and an O-ring seal 15 into the rest position shown in the drawing.

A supporting bracket/adapter 36 acts as a housing cover for the air pump 12. This also accommodates a rear bearing 34 (shown in the drawing) and a front bearing (not shown in the drawing) for the yoke 31, and by means of a mounting rail 37 on the back, provides a method of mounting whereby the appliance can be slid on to a well-known appliance housing, not shown in the drawing. The ball 5*a* of the outlet valve 5 is pressed into a corresponding valve seat by a valve spring 9, while the second end of the valve spring 9 rests in a bore in a foaming unit 18, shown in plan view. Below the foaming unit 18, and connected to it by a mixing nozzle, is the expansion part 19*a* of an expansion/conditioning chamber, with an initial cross section q1. The expansion part 19*a* leads into a conditioning part 19*b*, with an orifice of rectangular shape 19*c* interposed between the two parts 19*a* and 19*b*. The cylindrical cross section q2 in the part 19*b* is larger than the cross section q1, which is also cylindrical. An air outlet 16 is provided in the end-face area of the cylindrical space 11 of the air pump 12, which is connected to the interior space of an anti-fluctuation chamber 17 in which the foaming unit 18 is arranged concentrically.

The inlet valve 4 is connected by a hole 4' to the interior space of a housing 38, which acts as a temporary soap reservoir. This temporary reservoir is supplied with liquid soap by a well-known bottle, not shown in the drawing, screwed into a connection 39 which forms part of a cover 40 of the housing 38.

The housing 38 accommodates an air passage 41 connected to the rear of the air pump 12 and leading to a ring duct 42 incorporated in the cover 40, which in turn is connected to a vertical air supply 43, a horizontal air supply 44 and a blow-out duct 45,45'. A blow-out valve 6 with a corresponding valve ball is located at the end of the blow-out duct 45'. A cylindrical inlet flow adjuster is provided below the valve 6, and arranged concentric with the top. end of the conditioning part 19*b*.

The method of operation of the appliance as shown in FIG. 1 is as follows:

When the actuator lever 33 is pulled by hand in the direction of the arrow P, it acts on the piston rod 27, on which the flexible piston 14 and the piston head 24 are arranged. The effect of this—when the cylindrical space 2 is filled—is to convey soap solution and air at the same time; the air inlet valve 7, with valve cover 8, shuts at the start of the piston rod stroke. The soap pushes the floating and resilient ball 4*a* upwards and the ball 5*a* downwards, i.e. soap solution and compressed air are delivered to the foaming unit 18 and there converted to foam.

The soap foam thus formed expands first in the mixing nozzle 53 of the foaming unit 18 and then in the horizontal region of the expansion part 19*a*; the foam which follows then pushes the foam formed first through the vertical cylindrical-shaped region of the expansion part 19*a*; it is then compressed in the orifice 19*c*, re-expands in the larger cross section q2 and is conditioned in the part 19*b* before leaving through the outlet nozzle 10.

The conditioned foam ejected through the outlet nozzle 10 is of a high homogeneity and fineness, and is stable in its volume.

When the lever 33 is released, the spring 13 presses the piston 14 backwards again, so that air is compressed by a double-acting piston and flows through the ducts 41 to 45' into the air inlet part 10 and ejects all the foam present in the expansion part 19*a*.

The appliance is then ready for use again, as the floating valve ball 4*a* is lifted off its valve seat at the start of the return stroke by the static soap pressure in the temporary reservoir, so that the cylindrical space 2, supported by the partial vacuum, fills with soap completely.

The valves used are arranged so that their rest position corresponds to their shut position. This ensures that they fulfil their function even with very small flows (virtually static). In addition, the ball guide is designed for a small gap width of approximately 0.5 mm; the ball guide consists in a known manner of four boundary surfaces, so that any sticking is rectified by the hydraulic forces already operating on the ball.

Commercially-available balls made of elastomer, particularly silicone rubber, have proved to be highly suitable.

The pressure range, measured at the outlet of the metering pump, extends to a maximum of 1.5 bar; the air pressure, measured at the outlet of the air cylinder, indicates a maximum pressure of 0.2 bar.

The typical duration of actuation of the foam dispenser is in the order of one second. Shorter or longer actuations do not have any adverse effect on the foam quality.

The optimum metering volume has proved to be 0.4 ml of soap solution per stroke, with an approximately 30-fold volume increase into foam. The resulting foam volume of 12.5 $cm^3$ gives the illusion of a "piece" of soap due to its high consistency.

As can be seen in FIG. 2, the foaming unit 18, which is a known item (CH-A5-676 456) is surrounded by an inner flange 61, which in turn is partially surrounded by an outer flange 62 and mounted in a detachable manner underneath the valve 5 and concentric with it.

It can be easily seen from FIG. 2 that the metered quantity of soap solution flows into the foaming unit 18 through a central mixing duct 54 in an inlet flow adjuster 56. At the same time, a volume of air, compressed synchronously with this, is introduced through a so-called anti-fluctuation chamber 60 into the mixing duct 54, where it encounters the conical deflector 50; the foam formation starts, due to a continuous swirling of soap solution and air, without any interruptions. The coarse foam thus formed then pushes through a commercially-available microfilter (fleece), which is not shown in the drawing, and six coaxial holes in a mixing element 51 into a mixing chamber 52, where it is made finer. The foam enters the expansion part 19*a* through a mixing nozzle 53, the volume of which is smaller than that of the expansion part 19*a*, and is pushed by the foam following behind it so that it changes direction through the rectangular orifice 19*c* into the expansion part 19*b* and, as described above, into the outlet nozzle 10.

At its top end the inlet flow adjuster 56 has a deep, circumferential groove which acts as an internal air buffer 55 and, like the anti-fluctuation chamber 60, ensures a smooth introduction of the air into the mixing duct 54. This kind of inflow into the foaming unit 18 is very largely responsible for the continuous swirling described above and in this way initiates the high-quality foam formation.

The inlet flow adjuster 56 is retained by a support flange 57, held in place by the latter's circumferential locking part 28 and positioned symmetrical to the axis by a centring bush 59.

All the parts in FIG. 2 are dimensioned to fit inside one another and are fixed by screws and seals, not shown here, to the metering pump in FIG. 1 by corresponding flanges. Similarly, the end of the blow-out duct 45' is fitted to the remaining part of the duct in FIG. 1.

While the soap foam dispenser in FIG. 1 and FIG. 2 is designed to fit an existing model, or to fit in its housing, the designs in FIGS. 3 to 6 represent individual solutions of different designs to the subject of the invention.

FIG. 3 shows a foam dispenser which although capable of being accommodated in a housing of the known type, is fitted with a soap bottle 70 which has a greater volume than that used in the arrangement shown in FIG. 1.

The appliance housing 71 is intended for mounting on a wall W, usually above a washbasin.

The components known from FIGS. 1 and 2 are also present here, but the metering pump 1 has a fixed piston head 24, with two outlet passages 22' running through it. A piston rod 27' containing the cylindrical space 2, and incorporating the flexible piston 14 with is lip seal 15', is arranged so that it can be moved axially. The outlet valve 5, as previously described, is arranged in an axial direction in the foaming unit 18 at the end of the outlet passage 22. Its ball is pressed against a valve seat by a spring 9 over the bore 22'. The foaming unit 18 again has the described outflow aid in the form of an anti-fluctuation chamber 17. The mixing nozzle 53, which is horizontal here, discharges transversely through the expansion part 19*a* into the expansion/conditioning chamber, which is again of a siphon-type design.

All the other parts correspond to the arrangement in FIG. 1; the exception is that the blow-out duct 45' is connected to the air outlet 16 of the air pump 11, which is preloaded by the spring 13, by a differently-routed variant of a ring duct 42'.

The appliance shown in FIG. 4 is also intended for mounting on a wall W; the actuation force P acts here vertically on the lever 31 or 31' and is applied by a Bowden cable 72. This model is primarily intended for actuation by foot by a means not shown here (pedal, push button, etc.).

In this version the cam 30 acts on the vertical air pump 12. The other parts correspond to appliances already described, the exception being that the inlet valve 7 is here arranged asymmetrically to the cylindrical space 11, and the horizontal air supply is marked as 44.

This appliance has the advantage of hygienic actuation and, by virtue of its compact design, can accommodate a larger soap bottle 70 and a larger temporary soap reservoir 38'.

The appliance shown in FIG. 5, which is also intended for wall mounting, is of similar construction to the previous models. Actuation here is by the actuation button, which protrudes from the appliance housing 71 with its piston rod 27'.

The air supply for the blow-out process here is also asymmetric, via air supply ducts shown by dotted lines 43' and a ring duct 42'. In addition, a relatively solid central bearing 74 is provided which absorbs the moments resulting from any non-axial action of the actuation force P on the button 33 or the piston rod 27', and transmits them to the housing 71.

The appliance shown in FIG. 6 can be constructed as a table-top model. The components discussed above can again be seen here, as can the reinforced central bearing 74 and a suction tube 73 extending into the soap bottle 70' underneath. The short air supply 44', which also flows through a inlet flow adjuster 46 coaxially to the conditioning part 19*b*, is advantageous here, so that a portion of foam is dispensed to a hand held under the outlet nozzle 10.

The housing 71' can naturally be made free-standing, and glued to the table T if required.

Contrary to the appliances described above, the last two are for two-hand operation.

It has been shown that the object of the invention, in the combination of a metering pump without dead spaces and working in a repeatable manner, together with precision-closing valves, and with a pulse-free, encapsulated foaming unit with a coaxial inflow, produces an outstanding foam quality with very low soap consumption. Long-term tests have shown that at least 1000 hand washings can be done with 400 ml of soap solution.

The appliance is therefore very environmentally-friendly in operation and clean (drip-free), ergonomically favourable and, by virtue of its operational reliability, extremely well suited for installation in public washrooms.

We claim:

1. Appliance for forming soap foam, with a metering pump (2, 24, 25, 27) for soap solution, actuated by a single lever (31, 33), with a piston capable of reciprocating motion (24, 25, 27) within a cylindrical space, and a device for compressing and introducing air (12), coaxial to the metering pump (2, 24, 25, 27) capable of reciprocal motion and moved synchronously with the latter, in which openings and/or ducts (22, 16) which can be closed lead into a foaming unit (18) where fine-bubbled foam portions are formed, characterised by the fact that the end face of the cylindrical space (2) is flat in shape, that an inlet ball valve (4) and a spring-loaded outlet ball valve (5) are arranged opposite each other at the flat end face of the cylindrical space, and that the end face of the piston head (24) is flat, and that the lever (31, 33) presses the piston (24, 25, 26, 27) so that it makes positive contact against the end of the cylindrical space (2) when in its end position.

2. Appliance as in claim 1, characterised by the fact that end faces of the piston (24, 25, 26, 27) and the cylindrical space (2) are chamfered round their circumference (25, 20) to match each other.

3. Appliance as in claim 1, characterised by the fact that the ball (4*a*) of the inlet valve (4) has a lower density than the soap solution to be metered.

4. Appliance as in claim 3, characterised by the fact that the ball (4*a*) of the inlet valve (4) is made of elastomer.

5. Appliance as in claim 1, characterised by the fact that an expansion/conditioning chamber (19), cylindrical in shape, is connected to the foaming unit (18).

6. Appliance as in claim 5, characterized by the fact that the expansion/conditioning chamber (19) includes a vertically-arranged conditioning part (19*b*) having a first cross-section and an expansion part (19*a*) having a second cross-section, the first cross-section being larger than the second cross-section.

7. Appliance as in claim 6, characterised by the fact that an air blast at a pressure (P) is blown coaxially through the vertical conditioning part (19*b*) from a blow-out duct (45, 45').

8. Appliance as in claim 7, characterised by the fact that the blow-out duct (45, 45') is connected to an outlet from an air pump (12).

9. Appliance as in claim 7, characterised by the fact that an orifice (19*c*) is interposed between the expansion part (19*a*) and the conditioning part (19*b*).

10. Appliance as in claim 1, characterised by the fact that an anti-fluctuation chamber (60) is incorporated upstream of the foaming unit (18).

11. Appliance as in claim 10, characterised by the fact that an internal air buffer (55) is included in the foaming unit (18) in addition to the anti-fluctuation chamber (60).

* * * * *